US011612246B2

(12) United States Patent
Mackert

(10) Patent No.: US 11,612,246 B2
(45) Date of Patent: Mar. 28, 2023

(54) SEAT CHASSIS

(71) Applicant: Innotec Motion GmbH, Lippstadt (DE)

(72) Inventor: Michael Mackert, Rüthen (DE)

(73) Assignee: Innotec Motion GmbH, Lippstadt (DE)

( * ) Notice: Subject to any disclaimer, the term of this patent is extended or adjusted under 35 U.S.C. 154(b) by 0 days.

(21) Appl. No.: 17/244,549

(22) Filed: Apr. 29, 2021

(65) Prior Publication Data

US 2021/0244187 A1 Aug. 12, 2021

Related U.S. Application Data

(63) Continuation of application No. PCT/EP2019/080283, filed on Nov. 5, 2019.

(30) Foreign Application Priority Data

Nov. 7, 2018 (DE) ..... 202018106331.6

(51) Int. Cl.
*A47C 1/032* (2006.01)

(52) U.S. Cl.
CPC ..... *A47C 1/03205* (2013.01); *A47C 1/03222* (2013.01); *A47C 1/03294* (2013.01)

(58) Field of Classification Search
None
See application file for complete search history.

(56) References Cited

U.S. PATENT DOCUMENTS 2,313,023 A * 3/1943 Ruegger ..... A47C 3/03 297/269.1
4,004,836 A * 1/1977 Kristensson ..... A61G 5/12 297/301.2
5,669,324 A * 9/1997 Muir, III ..... B63B 29/12 297/216.19
5,967,609 A * 10/1999 Potter ..... A47C 3/03 297/261.3
6,106,065 A * 8/2000 Carroll ..... A47C 1/0347 297/325
7,090,296 B2 * 8/2006 Massimo ..... A47C 1/03211 297/319

(Continued)

OTHER PUBLICATIONS

Search Report in corresponding International Patent Application No. PCT/EP2019/080283, dated Mar. 17, 2020, with English translation.

*Primary Examiner* — David E Allred
(74) *Attorney, Agent, or Firm* — Edell, Shapiro & Finnan, LLC

(57) ABSTRACT

A seating furniture chassis comprises a seat surface frame, a backrest frame, two armrests, and a drive mechanism. The backrest frame is pivotable about a virtual pivot axis defined by two pivot points, wherein the backrest frame is fastened to the pivot points on the armrests. The drive mechanism is connected to the backrest frame by a translation mechanism. The drive mechanism is designed to trigger a translation of the translation mechanism, wherein the translation is converted into a pivoting movement of the backrest frame about the pivot axis. The backrest frame is connected below the pivot points to the seat surface frame so that during the pivoting movement the seat surface frame is moved translationally. The drive mechanism is arranged below a first lateral edge region of the seat surface frame.

12 Claims, 5 Drawing Sheets

(56) References Cited

U.S. PATENT DOCUMENTS

| | | | | |
|---|---|---|---|---|
| 7,823,976 | B2 * | 11/2010 | Mackert | A47C 31/126 297/301.7 |
| 9,022,473 | B2 * | 5/2015 | Crum | A47C 7/54 297/85 L |
| 9,326,608 | B1 * | 5/2016 | Hoy | A47C 1/0345 |
| 9,402,479 | B1 * | 8/2016 | Lin | A47C 1/0355 |
| 9,730,518 | B1 * | 8/2017 | Jacobs | A47C 7/70 |
| 10,682,271 | B2 * | 6/2020 | Lin | A47C 7/5068 |
| 2015/0035322 | A1 | 2/2015 | Lin | |
| 2020/0260883 | A1 * | 8/2020 | Jacobs | A47C 1/029 |

* cited by examiner

SEAT CHASSIS

CROSS REFERENCE TO RELATED APPLICATIONS

This application is a continuation of International Application No. PCT/EP2019/080283, filed on Nov. 5, 2019, which claims priority under 35 U.S.C. § 119 to Application No. DE 202018106331.6 filed on Nov. 7, 2018, the entire contents of which are hereby incorporated by reference.

TECHNICAL FIELD

The present disclosure relates to a seating furniture chassis.

BACKGROUND

Seating furniture chassis are known from the prior art. They are used, for example, for chairs or armchairs. An upholstery, on which a user can sit, is attached to the seating furniture chassis. Seating furniture chassis with a pivotable backrest frame and a translationally movable seat surface frame are known. Seating furniture chassis in which the movements of the backrest frame and the seat surface frame are coupled to each other are known.

SUMMARY

In contrast, the object of the disclosed apparatus is to provide a particularly compact seating furniture chassis in which a drive mechanism is used for adjusting the backrest frame and the seat surface frame. In addition, a piece of furniture for sitting is to be provided with such a seating furniture chassis.

The disclosed seating furniture chassis comprises a seat surface frame, a backrest frame, two armrests, and a drive mechanism. In this case the seat surface frame is to be understood in the context of this description as meaning a frame to which an upholstery can be attached, which upholstery can be used by a user as a surface for sitting. In the context of this description, a backrest frame is to be understood as meaning a frame to which an upholstery can be attached that can be used as a backrest by a user sitting on the seat surface. In the context of this description the armrests are to be understood as meaning a construction to which an upholstery can be attached that can be used as an armrest by a user sitting on the seat surface.

The backrest frame is pivotable about a virtual pivot axis. In this case, a virtual pivot axis is to be understood in the context of this description as meaning a geometric axis that is not present as a component but rather serves only to define the pivoting movement. The pivot axis is defined by two pivot points. The backrest frame is fastened to the pivot points on the armrests.

The drive mechanism is connected by a translation mechanism to the backrest frame. The drive mechanism can be, for example, an electric motor. The drive mechanism is designed to trigger a translation of the translation mechanism. The translation is converted into a pivoting movement of the backrest frame about the pivot axis. The backrest frame is connected below the pivot points to the seat surface frame, so that during the pivoting movement the seat surface frame is moved translationally. In this case the term "below" is to be understood in the context of this description as meaning the direction that is down when the seating furniture chassis is used as intended. Below the seat surface frame, for example, a foot of the seating furniture chassis can also be arranged, said foot being arranged on the floor when the seating furniture chassis is used as intended.

The drive mechanism is arranged below a first lateral edge region of the seat surface frame. This arrangement is particularly space efficient, so that the seating furniture chassis can be designed so as to be particularly space saving. In the context of this description, a lateral edge region is to be understood as meaning an edge region that faces the armrests. The lateral edge regions can be connected to side struts of the seat surface frame. In this case, the side struts extend from the rear to the front. In the case of the seating furniture chassis that end of the seat surface frame that faces the backrest frame can be at the rear. In this case, that end of the seat surface frame that is opposite the rear end is at the front.

In accordance with one disclosed embodiment, the seating furniture chassis may comprise guide members and guide elements. The guide members can be arranged below the armrests. During the translational motion the seat surface frame can be guided with the guide elements in the guide members. This type of guide is particularly compact.

In accordance with one disclosed embodiment, the guide members may exhibit a curvature. In this way, the seating furniture chassis is automatically adjustable in height when the backrest is pivoted.

In accordance with one disclosed embodiment, the guide elements can be arranged next to the front region of the seat surface frame. In this case, the front region is to be understood in the context of this description as meaning the front half of the seat surface frame.

In accordance with one disclosed embodiment, the guide members may be curved forward upward. In this way, it can be achieved that during a pivoting movement of the upper part of the backrest frame rearward, the seat surface frame is moved forward upward. This aspect is often perceived to be particularly convenient.

In accordance with one disclosed embodiment, the guide elements may be shaped like rollers. In the context of this description, this aspect is to be understood as meaning that the guide elements roll on the guide members.

In accordance with one disclosed embodiment, the translation mechanism may be fastened to the lower end of the backrest frame on the backrest frame. In this way, a particularly large deflection of the backrest frame can be achieved. This aspect is particularly advantageous if the drive mechanism is fastened, for example, to the seat surface frame and during a translational motion of the seat surface frame moves along with it.

In accordance with one disclosed embodiment, the seat surface frame may be fastened between the translation mechanism and the pivot points on the backrest frame. This aspect is particularly advantageous if the drive mechanism is fastened, for example, to the seat surface frame and during a translational motion of the seat surface frame moves along with it.

In accordance with one disclosed embodiment, the translation mechanism may be designed as a threaded rod.

In accordance with one disclosed embodiment, the pivot points may be arranged on the pivot axis.

In accordance with one disclosed embodiment, the drive mechanism may be arranged below a rear region of the seat surface frame.

In accordance with one disclosed embodiment, the drive mechanism may be connected to a bracket, which is arranged below the seat surface frame. The bracket may be securely connected to the seat surface frame. In the context of this description, this aspect is to be understood as meaning that during a translation of the seat surface frame the bracket moves translationally in the same manner.

In accordance with one disclosed embodiment, the seating furniture chassis may comprise a further drive mechanism arranged below a second lateral edge region, which is arranged opposite the first edge region.

BRIEF DESCRIPTION OF THE DRAWINGS

Other features and advantages of the disclosed apparatus will become apparent from the following description of example embodiments with reference to the accompanying drawings. In this case, the same reference numerals are used for the same or similar components and for components having the same or similar functions.

DETAILED DESCRIPTION

Figure 1:
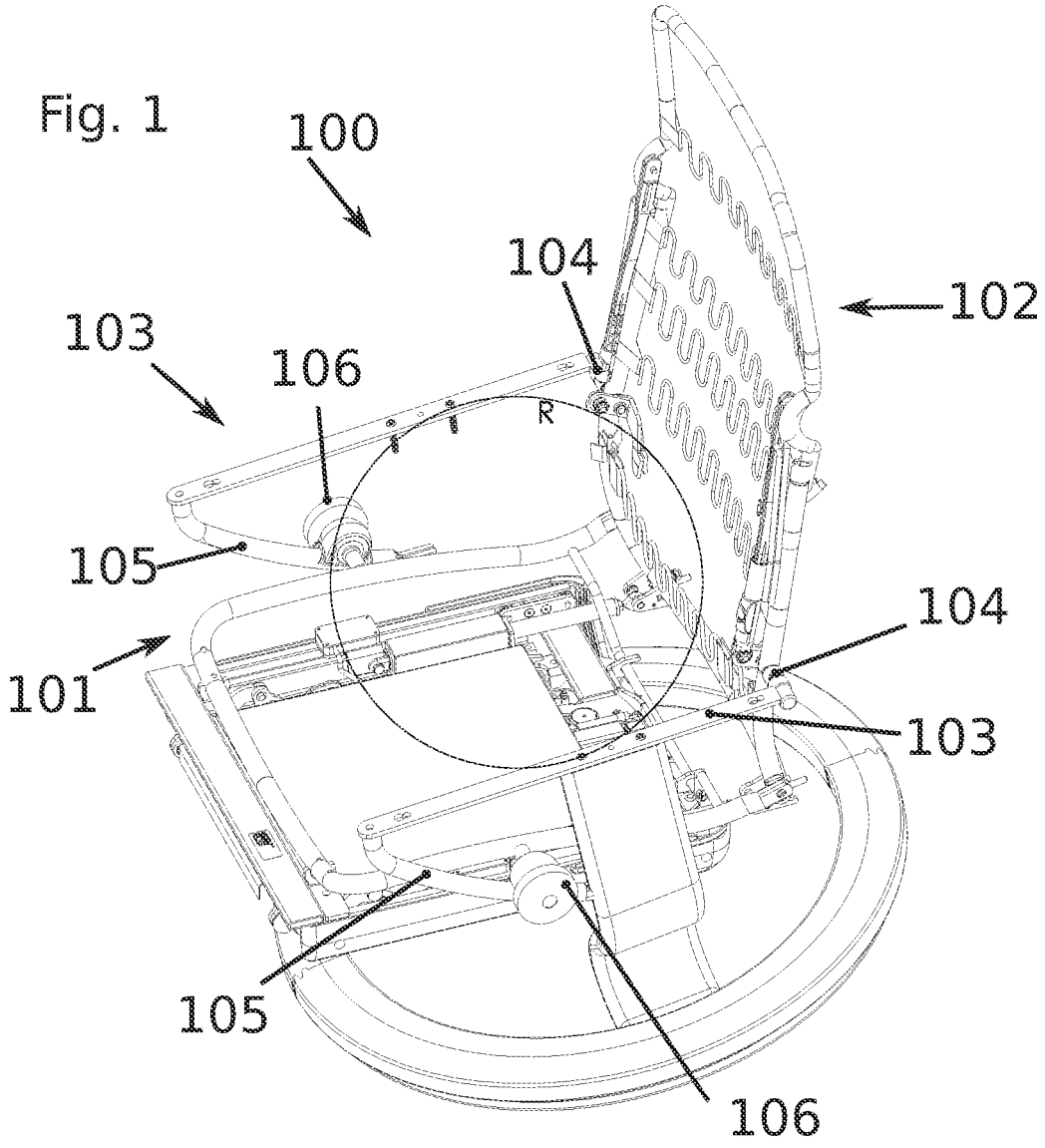
FIG. 1 is a perspective view in schematic form of a seating furniture chassis in a first position in accordance with one embodiment.
Figure 5:
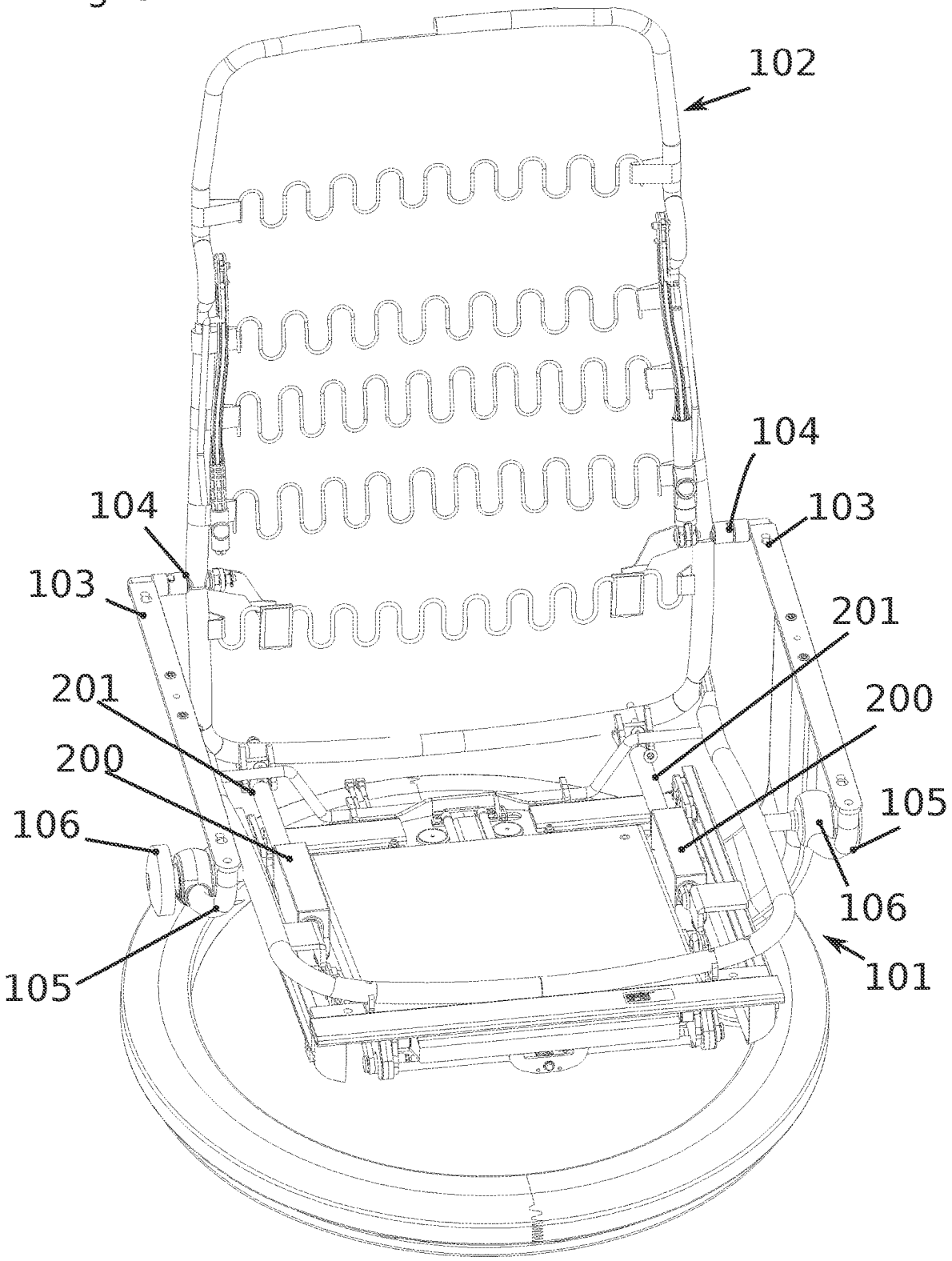
FIG. 5 is a perspective view in schematic form of the seating furniture chassis from FIG. 1.

Referring to FIGS. 1 and 5, the seating furniture chassis 100 comprises a seat surface frame 101, a backrest frame 102, and two armrests 103. The armrests 103 are fastened to fastening points 104 on the backrest frame 102. The seat surface frame 101 is connected to the lower end of the backrest frame 102. When the backrest frame 102 is pivoted, the two fastening points 104 define the geometric pivot axis.

Figure 2:
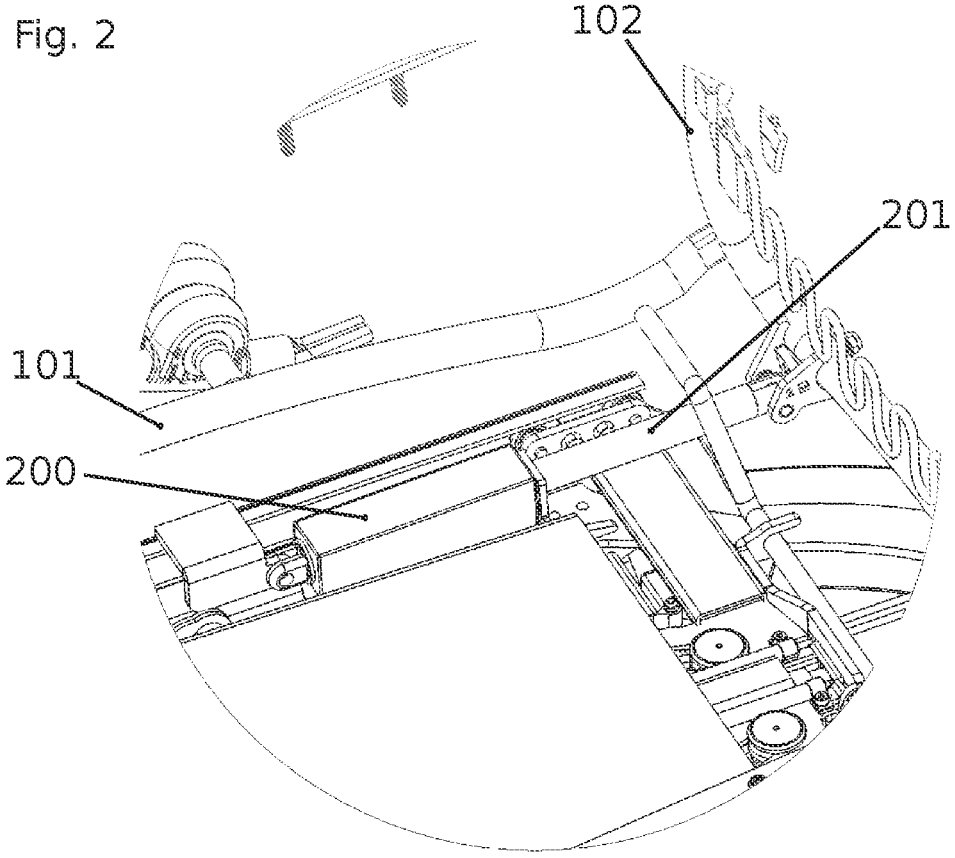
FIG. 2 shows a detail from FIG. 1 that is denoted by R.
Figure 4:
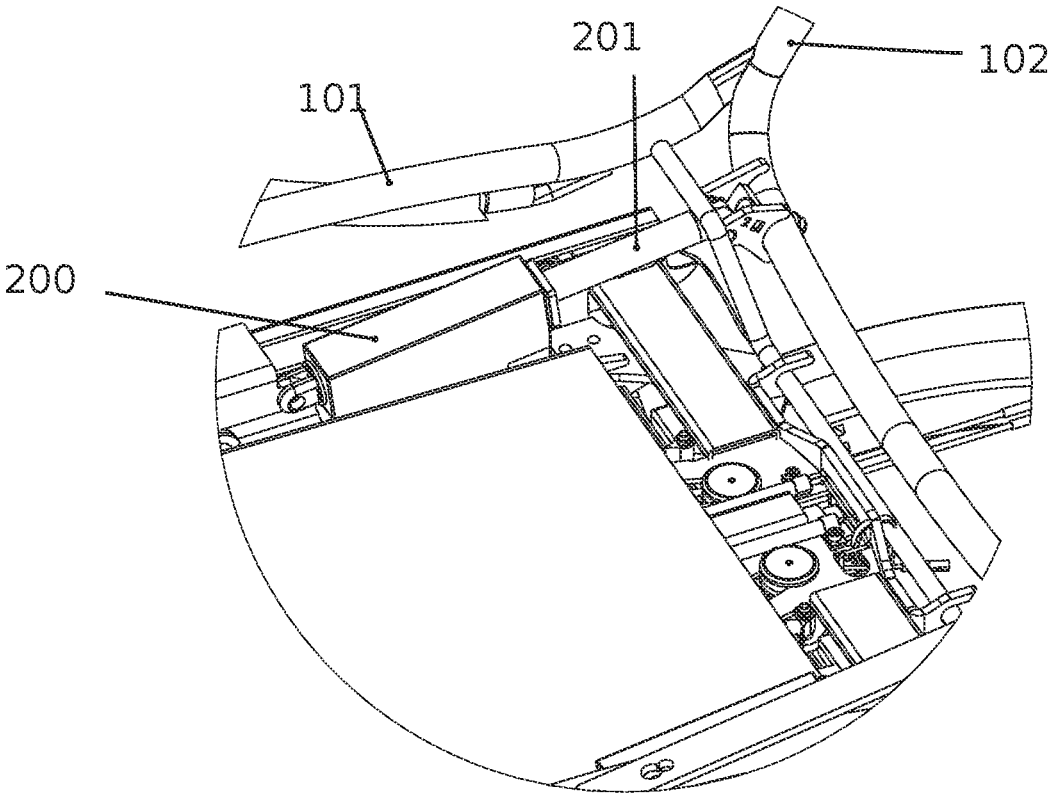
FIG. 4 shows a detail from FIG. 3, which is denoted by R.

As shown in detail in FIGS. 2 and 4, in both lateral regions below the seat surface frame 101, there is arranged in each case a drive mechanism 200, which is connected to the backrest frame 102 by a translation mechanism 201, for example, a threaded rod. The drive mechanism 200 is designed to trigger a translation of the translation mechanism 201. In this way, a translation of the translation mechanism 201 is converted into a pivoting movement of the backrest frame 102 owing to the connection with the backrest frame 102.

Figure 3:
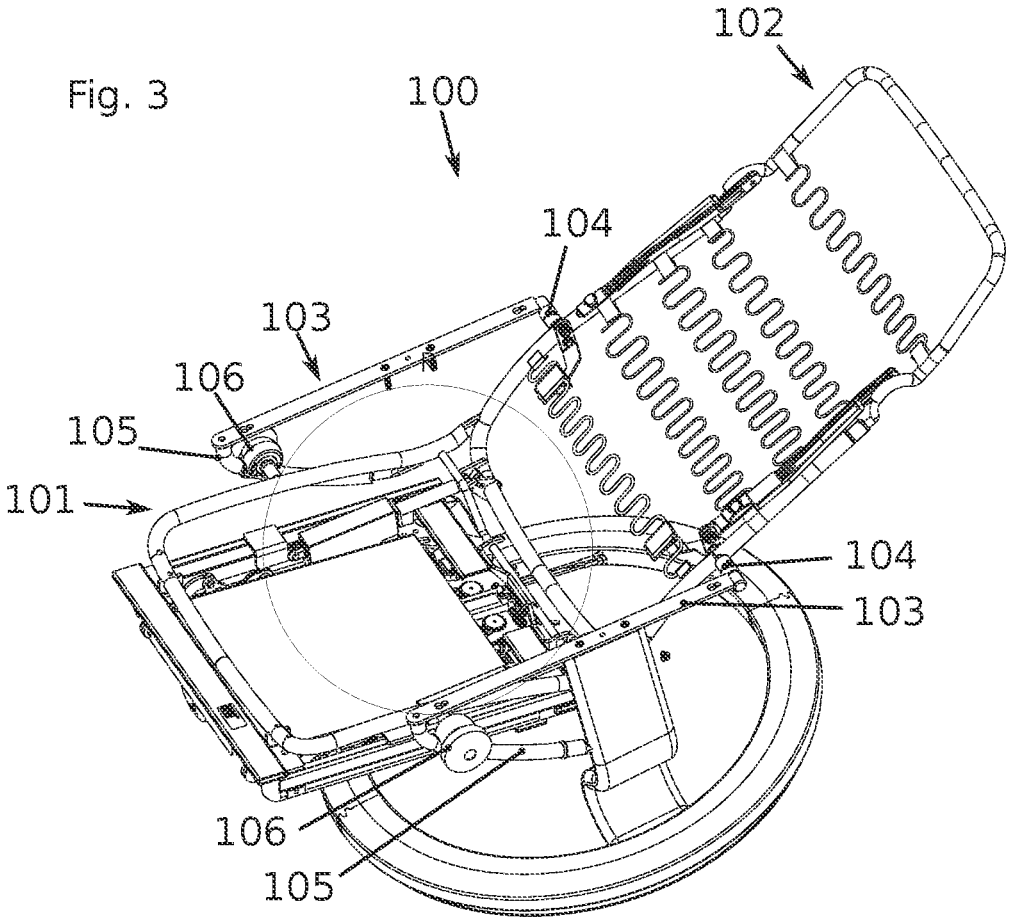
FIG. 3 is a perspective view in schematic form of the seating furniture chassis from FIG. 1 in a second position.

During the pivoting movement of the backrest frame 102, the seat surface frame 101 is moved translationally. When the upper region of the backrest frame 102 is pivoted rearward, the seat surface frame 101 is moved forward, as shown in FIGS. 3 and 4. When the upper region of the backrest frame 102 is pivoted forward, the seat surface frame 101 is moved rearward, and shown in FIGS. 1 and 2.

During the movement, the seat surface frame 101 is guided by guide elements 106 that are guided in guide members 105. The guide members 105 are formed so as to be curved and are arranged below the armrests 103. The guide members 105 are fastened directly to the armrests 103. The guide elements 106 are arranged laterally on the outside of the seat surface frame 101. As a result of the guide elements 106 being guided in the guide members 105, the seat surface frame 102 is raised forward during a movement and is lowered rearward during a movement.

The arrangement of the drive mechanism 200 in lateral edge regions directly below the seat surface frame 101 is advantageous, since such an arrangement is particularly space efficient. Very little installation space is required. Thus, there is a lot of room below the seat surface frame 101; and the drive mechanisms 200 are concealed during normal operation or can be seen by a user only with effort, so that they do not affect or only insignificantly affect the aesthetic appearance of the piece of furniture for sitting.

What is claimed is:

1. A seating furniture chassis, comprising:

a seat surface frame having a first lateral edge region;

first and second armrests with respective first and second pivot points defining a pivot axis;

a backrest frame connected to the first and second pivot points and pivotable about the pivot axis, and connected to the seat surface frame below the first and second pivot points;

a translation mechanism;

a drive mechanism arranged below the first lateral edge region of the seat surface frame, wherein the drive mechanism is connected to the backrest frame by the translation mechanism and configured to trigger a translation of the translation mechanism to cause a pivoting movement of the backrest frame about the pivot axis such that the seat surface frame is moved translationally;

guide members arranged below the first and second armrests, wherein the guide members include an elongated, curved portion having a direction of curvature extending lengthwise from the seat surface frame upward to the armrests; and guide elements guided on the elongated, curved portion of the guide members to guide the seat surface frame during the translation of the translation mechanism, wherein the guide elements, during the translation of the translation mechanism, have a direction of movement which corresponds to the direction of curvature of the guide members.

2. The seating furniture chassis of claim 1, wherein the guide members are curved forward upward.

3. The seating furniture chassis of claim 1, wherein the guide elements are arranged next to a front region of the seat surface frame.

4. The seating furniture chassis of claim 1, wherein the guide elements are shaped like rollers.

5. The seating furniture chassis of claim 1, wherein the translation mechanism is fastened to a lower end of the backrest frame.

6. The seating furniture chassis of claim 1, wherein the seat surface frame is fastened on the backrest frame between the translation mechanism and the first and second pivot points.

7. The seating furniture chassis of claim 1, wherein the translation mechanism comprises a threaded rod.

8. The seating furniture chassis of claim 1, wherein the first and second pivot points are arranged on the pivot axis.

9. The seating furniture chassis of claim 1, wherein the drive mechanism is arranged below a rear region of the seat surface frame.

10. The seating furniture chassis of claim 1, wherein the drive mechanism is connected to a bracket arranged below the seat surface frame, wherein the bracket is securely connected to the seat surface frame.

11. The seating furniture chassis of claim 1, further comprising a further drive mechanism arranged below a second lateral edge region of the seat surface frame, which is arranged opposite the first lateral edge region.

12. Seating furniture, comprising:
the seating furniture chassis of claim 1; and
upholstery fastened to the seating furniture chassis.

* * * * *